US006315863B1

(12) United States Patent
Jack

(10) Patent No.: US 6,315,863 B1
(45) **Date of Patent: *Nov. 13, 2001**

(54) CHLORINE DIOXIDE PULP BLEACHING PROCESS HAVING REDUCED BARIUM SCALING BY RECYCLING POST-CHLORINATION WASTE FILTRATE

(75) Inventor: David B. Jack, Tacoma, WA (US)

(73) Assignee: Weyerhaeuser Company, Federal Way, WA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/100,158

(22) Filed: Jun. 18, 1998

(51) Int. Cl.[7] ..... D21C 9/14; D21C 11/00

(52) U.S. Cl. ..... 162/40; 162/48; 162/88; 162/89

(58) Field of Search ..... 162/88, 89, 65, 162/76, 78, 38, 48, 39, 67, 40

(56) References Cited

U.S. PATENT DOCUMENTS

| | | | | |
|---|---|---|---|---|
| 4,104,114 | * | 8/1978 | Rowlandson et al. | 162/89 |
| 4,229,252 | | 10/1980 | Meredith | 162/65 |
| 4,238,281 | * | 12/1980 | Histed | 162/89 |
| 4,298,426 | | 11/1981 | Torregrossa et al. | 162/65 |
| 4,537,656 | * | 8/1985 | Lindahl et al. | 162/88 |
| 4,543,155 | | 9/1985 | Stawicki . | |
| 5,616,278 | | 4/1997 | Carey et al. . | |
| 5,693,184 | | 12/1997 | Gandek et al. . | |
| 5,728,264 | * | 3/1998 | Pangalosi | 162/69 |

FOREIGN PATENT DOCUMENTS

| | | |
|---|---|---|
| 1086905 | 10/1980 | (CA) . |
| 39 37 932 A1 | 5/1991 | (DE) . |
| 1 396 139 | 6/1975 | (GB) . |
| WO 98/21400 | 5/1998 | (WO) . |

OTHER PUBLICATIONS

Reeve, Douglas W., "Delignification Process Variables", *Pulp and Paper Manufacture*, 5:448, 449, 463, 464.

* cited by examiner

*Primary Examiner*—Steve Alvo
(74) *Attorney, Agent, or Firm*—Christensen O'Connor Johnson Kindness PLLC

(57) ABSTRACT

Collection of a post-chlorination washer filtrate and recycle thereof to acidify a wood pulp stream entering the initial chlorine dioxide bleaching stage is provided in order to reduce the formation of barium scale.

2 Claims, 7 Drawing Sheets

CHLORINE DIOXIDE PULP BLEACHING PROCESS HAVING REDUCED BARIUM SCALING BY RECYCLING POST-CHLORINATION WASTE FILTRATE

FIELD OF THE INVENTION

The present invention relates to the bleaching of wood pulp and a method of reducing the amount of barium scale that is formed on equipment used in the bleaching process.

BACKGROUND OF THE INVENTION

For many years chlorine was used predominantly as the primary bleaching agent for wood pulp. When chlorine was used as the bleaching agent in the first bleaching stage, the consistency of this stage was preferably in the range of about 2.0–5.0% solids. Since the process stream coming to the first bleaching stage typically had a consistency much higher than desired for the first bleaching stage, it was often diluted with filtrate from a chlorination washer for the first bleaching stage. This recycle of the washer filtrate reduced water usage and reduced energy costs. There was also an additional benefit in that with the filtrate recycle, the pulp delignification was improved slightly.

As the industry moved away from the use of chlorine and substituted chlorine dioxide, it became necessary to increase the retention time of the pulp in the reaction tower because of the reduced reaction rate of chlorine dioxide compared to reactions involving chlorine. A typical way of increasing the retention time has been to increase the consistency of the pulp stream to about 10 to 12% solids. As a result of increasing the consistency of the pulp stream in chlorine dioxide bleaching processes, it became unnecessary to recycle chlorination washer filtrate for dilution.

Barium is present in the pulp stream and originates from the wood chips that serve as the raw material for the wood pulp.

The bleaching ability of chlorine dioxide depends in part on pH. The bleaching efect of chlorine dioxide is maximized at a pH of about 2.3 to 3.0. Since the pH of the pulp stream into the bleaching stage is typically more basic than 2.3 to 3.0, acid is typically added to the pulp stream. The most common acid has been sulfuric acid because of its relatively low cost and availability. While the addition of sulfuric acid effectively reduces the pH, it also increases the number of sulfate ions which are available to react with barium and precipitate as barium sulfate, forming unwanted scale on equipment. When scale forms on equipment, such as the chlorination washer, the ability of the equipment to remove unwanted materials, reaction products and unreacted chlorine dioxide is reduced. One of the side effects of reducing the ability of a washer to remove unwanted materials is that less calcium is removed in the washer, and thus passes downstream to extraction stages where the calcium is available to react with carbonate ions and precipitate out as calcium carbonate and form additional unwanted scale.

Hydrochloric acid is another acid that has been used in a manner similar to sulfuric acid to acidify the pulp stream; however, when hydrochloric acid finds its way into filtrates, the utility of such filtrates is reduced. Often such hydrochloric acid containing filtrates require expensive treatment in order to render the filtrate stream disposable.

In certain bleaching processes, pH of the pulp stream has been controlled by applying excess amounts of chlorine dioxide to the pulp. Apparently, such larger doses of chlorine dioxide are effective to sufficiently acidify the pulp such that the addition of sulfuric acid is not needed. In those chlorine dioxide bleaching processes that do not or cannot apply excess amounts of chlorine dioxide, and thus employ sulfuric acid as a pH adjustment chemical, the formation of barium scale continues to be problematic.

In view of the costs involved in removing barium scale and calcium scale from pulp bleaching process equipment, the need exists for a solution to reduce or avoid the formation of barium sulfate which can lead to scale formation on process equipment. Such an improvement would reduce the cost of pulp bleaching processes by reducing down time and costs associated with removal of both barium scale and calcium scale from equipment.

As an aid in understanding the prior art as it relates to a typical pulp mill, and more specifically, the bleaching process within a pulp mill, a typical pulp mill operation is described below.

FIGS. 1A–1C illustrate a typical pulp mill. In the mill, means of transporting chips or pulp from one operation to another will depend upon the consistency of the pulp and the location of the equipment. The transportation may be accomplished by a conveyor or a chute if the consistency is too high for the pulp or chips to be pumped. If the pulp or chips can be pumped, a pipe can be used to transport the material.

Chips 10, process water 11, steam 12 and pulping chemicals 13 are placed in digester 14. Wood chips 10 may optionally be treated prior to entering digester 14 by conventional means such as by pre-steaming the chips in a steaming vessel or impregnating the chips with digestion chemicals in an impregnation vessel. Chemicals 13 that are contacted with the chips will depend on the process being used, e.g., sulfate, sulfite, or soda, and whether or not digester 14 is operated in a batch or continuous mode. In FIGS. 1A–1C, a continuous digester is illustrated. Chips are cooked under appropriate conditions within digester 14. The cooking conditions will depend upon the species of chip and the type of pulp being used and are well known.

The products of the digestion process are delignified or partially delignified wood chips, spent pulping chemicals, and lignin and carbohydrate products which have been removed from the wood chips in the digestion process. Treatment of the chips after cooking, will depend in part on the type of digester being used. A major portion of the spent pulping chemicals and lignin products are removed from the chips prior to further processing by washing. In a continuous digester as illustrated, the chips are washed in a washing section of the digester. This is indicated by process water 15 entering the washing stage of digester 14 and an effluent stream 16 leaving the washing stage of digester 14. Effluent 16 will consist of the lignin and carbohydrates which have been removed from the chips during the digestion process and spent pulping chemicals. This effluent is carried to a treating facility for processing. If the pulp is Kraft or sulfate, such treating facility would include a recovery system wherein the liquor is burned to recover the pulping chemicals for reuse. Such treatment would not occur in a batch digester where all the washing would occur in the following brown stock washing system.

Following this washing treatment, the chips are passed from digester 14 through a blow line to storage or blow tank 22. It is customary in pulp mills to have storage tanks between separate processes so that the entire mill will not shut down if one section of the mill is taken off line. Storage tank 22 is located between the digester stage and the subsequent washing or bleaching stages.

Material passing through the blow line comprises a slurry that contains the remaining lignin and carbohydrates, spent digestion chemicals, and fibers formed from the chips as they are blown from the digester. The chips are formed into fibers when the pressure on the chips is partially released, usually at the outlet of digester 14. The slurry will still be under some pressure to move it through the blow line. If digester 14 is a continuous digester, additional fiberizing may be accomplished by a refiner, or refiners, in the blow line. Such refiners fiberize large particles that have not been reduced to fibers earlier in the process. In FIG. 1A, two refiners, 18 and 19, are illustrated; first refiner 18 does coarse refining and second refiner 19 does fine refining. It should be understood that such refiners are optional and often are encountered in a liner board mill; however, in a bleached pulp mill refiners would normally not be included in a blow line. In addition, such refiners would not be employed if digester 14 was operated in a batch mode.

The blow line is shown in three sections, section 17 between digester 14 and refiner 18; section 20 between refiners 18 and 19; and section 21 between refiner 19 and storage tank 22.

From storage tank 22, fibers and liquor are carried by pumps 23 through line 24 to washing and screening equipment. The system will be described by first following the pulp through the system and then following the wash water through the system.

The pulp slurry is first carried to brown stock washers 28, where preferably substantially all of the remaining lignin and spent digestion chemicals are removed from the fibers. In FIG. 1A, four washers are illustrated. Typically, this is the number of washers that would be used for the batch digester. The washing section of a continuous digester may replace the first two brown stock washers. Each of the washers is usually a vacuum or pressure drum washer or vacuum or pressure drum filter and the operation of each is the same and well known. The operation of a vacuum or pressure drum washer will be described. Some of the washers may, however, be diffusion washers in which case, the pulp slurry would not be diluted prior to entering the washer.

Pulp slurry from line 24 enters vat 30 of washer 31. Vacuum drum 32 revolves through the vat, and the vacuum pulls the fibers in the slurry onto the outer surface of the filter drum and holds the fibers, in that form, against the surface. Liquor or filtrate are pulled through the filter cloth to the interior piping of the vacuum drum to be discharged as effluent. The revolving drum carries the fiber mat from the vat past a bank of washer heads that spray a weak filtrate onto the mat to displace the liquor from the mat. The vacuum also pulls this displaced liquor into the interior piping of the drum. The consistency of the mat leaving a washer, either the brown stock washers described here or the bleach washers described later, will usually be between about 8 to 15 wt. %.

Pulp mat 33 is removed from the face of drum 32 by a doctor blade, carrier wires or strings between the drum and the mat, rolls or any other standard manner and carried to vat 50 of second brown stock washer 51. Again, the fibers are picked up on vacuum drum 52 where the mat is washed with still weaker filtrate, removed from vacuum drum 52 and carried to vat 70 of brown stock washer 71. Operation of this washer is the same as the others. In brown stock washer 71, vacuum drum is identified by reference numeral 72 and the mat is identified by reference numeral 73. Mat 73 is carried from brown stock washer 71 to vat 90 of the last brown stock washer 91. Again, the operation of this washer is the same as the others with the vacuum drum being identified as reference numeral 92 and the mat as reference numeral 93.

From the brown stock washers, the pulp mat is carried to storage tank 110 with the aid of stock pump 96. In the lower section of tank 110, the pulp is diluted and then carried through line 111 by pump 112 to screens 113 in FIG. 1B. In screens 113, the larger fiber bundles and knots are separated. The bundles and knots 114 are delivered to further treatment sites.

Pulp 115 is carried from screens 113 to decker 121 where additional water is removed. The operation of the decker is similar to that of the washers and is well understood. Washing showers may or may not be used in the decker. The decker includes vacuum drum 122 and pulp mat 123. The pulp mat 123 is pumped by stock pump 126 to a high density storage tank 140 where the pulp is stored until it is bleached.

The liquor or filtrate from decker 121 may be handled in several ways, which may or may not occur simultaneously. While the following description is specific to the effluent from tank 129, it is also illustrative of how the effluent from any of the washers in the brown stock washing system 28 can be handled.

First, filtrate from tank 129 can be reused to reduce the consistency of pulp slurry either entering decker 121, entering screens 113, or leaving storage tank 110. Line 130 carries filtrate to lines 131, 133 and 135. Line 131 and pump 132 carry filtrate back to screened pulp 115 to reduce the consistency of the pulp slurry entering decker 121, preferably to around 1.5 wt. %. Line 133 and pump 134 carry filtrate back to line 111 to reduce the consistency of the pulp slurry entering screens 113 to about 0.2 to 2 wt. %. Line 135 and pump 136 carry filtrate back to storage tank 110 to reduce the consistency of the pulp slurry leaving the tank to about 5 wt. %.

Second, the filtrate not reused for dilution may be taken to an effluent treatment system by line 130 and effluent line 29. This treatment may include combining the effluent with the effluent in line 16, or carrying the effluent directly to a cooking liquor recovery system. It should be understood that in a batch digester system, the digester effluent is recovered completely from the brown stock washing system while in a continuous digestion system only a portion of the digester effluent is recovered from the brown stock washers.

All of the remaining filtrate would be handled as effluent if counterflow washing, described below, is not employed. Some of the filtrate may be handled as effluent even if counterflow washing is employed.

Third, filtrate from tank 129 may be used as wash water in the brown stock washing system 28 in a counterflow washing system. In this configuration, filtrate flows counter to the flow of pulp. Line 137 and pump 138 carry filtrate back to brown stock washer 91 for use as wash water. The filtrate is sprayed on the pulp mat by washer heads 95 and displaces the liquor within the mat. This filtrate may also be sprayed on the carrier wires, strings or rolls after the pulp mat is separated therefrom to remove any pulp fibers that cling to the wires, strings or rolls. Additional water may be required to supplement the filtrate and may be provided through process water line 97.

The flow of filtrate through brown stock washer 91 is the same as the flow through decker 121. The liquor, either from the mat or the vat, is carried through internal piping to line 98 and through line 98 to filtrate storage tank or seal tank 99. The filtrate from the seal tank may be handled in a number of ways. For example, line 100 can carry it to effluent line 29. Line 101 and pump 102 can carry the filtrate to pulp 73 to reduce the consistency of the pulp slurry to about 1½ to 3½ wt. % as it enters vat 90. Line 103 and pump 104 can carry the filtrate to brown stock washer 71 to be used as wash water.

The process and brown stock washers 71, 51 and 31 are for the most part, identical to the process in brown stock washer 91 so the parts are similarly numbered. Washer heads are identified, respectively, as 75, 55 and 35. The clean-up washers are identified by reference numerals 74, 54 and 34, respectively. Filtrate lines are identified by reference numerals 78, 58 and 38, respectively, and the filtrate storage or seal tanks are identified by reference numerals 79, 59 and 39, respectively. The filtrate lines from the seal tanks to effluent 129 are identified by reference numerals 80, 60 and 40, respectively.

The consistency of the slurry entering any of the vats 70, 50 or 30 is preferably about 1.5 to about 3.5 wt. %. The lines and pumps carrying the filtrate to the pulp to reduce the consistency of the slurry entering a vat are 81 and 82, 61 and 62, and 41 and 42, respectively. The counterflow wash water lines and pumps are 83 and 84, and 63 and 64, respectively.

In brown stock washer 31, line 43 and pump 44 carry the filtrate into storage tank 22 to reduce the consistency of the pulp slurry in the bottom of the tank to about 2 to about 3½ wt. % before it exits the tank.

In each of the brown stock washers, there is a possibility that additional process water may be needed to supplement the filtrate being used as wash water. Lines 77, 57 and 37 are for this purpose and provide all the wash water to the individual washers if the counterflow system described above is not used and parallel flow washing is used instead.

The washed pulp which has passed through the brown stock washing system 28, the screens 113 and decker 121 remains in storage tank 140 until it is carried into the bleaching system.

The bleaching process illustrated in FIGS. 1B and 1C will also be described by following the pulp stream through the bleaching system from washed pulp to bleached pulp and then by following the wash water from its entry into the process through to bleach plant effluent. The particular bleaching sequence illustrated is DED, where "D" represents a chlorine dioxide stage and "E" represents an alkali extraction stage. The process conditions are taken from the Tappi Monograph, No. 27, *The Bleaching of Pulp*, Rapson, Editor, The Technical Association of Pulp and Paper Industry, 1963, pages 186–187. It should be understood that there are many other bleaching sequences which are described in standard text.

Prior to decker 121, pulp mat 123 can be treated with a slight amount of alkali from line 187. Generally, a sodium hydroxide solution is used and is added to the mat at a point on the drum that will allow the solution to stay in the mat and not pass into the filtrate. The purpose of this treatment is to adjust the pH of a pulp prior to chlorine dioxide treatment. The pH of the pulp should be in the range of about 5 to about 7, preferably about 6, for optimum brightness when bleaching with chlorine dioxide. Alternatively, the alkali solution may be added in the storage tank 140 instead of decker 121. Alternatively, if the pH of the pulp mat is elevated, an acid, such as sulfuric acid can be added to lower the pH. Such acid can be added at the same locations that the alkali solution described above can be added.

From tank 140, the washed pulp is delivered to mixer 191 where it is combined with chlorine dioxide from line 192 prior to entering chlorine dioxide tower 193. This tower can be an upflow or upflow/downflow tower with the pulp remaining in the tower long enough to allow the chlorine dioxide to react with the pulp. Generally, the reaction is about complete after one hour, but can continue for up to about four hours. Prior to leaving the tower, the slurry is diluted, e.g., to a consistency of about 5 wt. %, in dilution zone 194. If necessary, based on the metallurgy of the equipment, the slurry may be treated with a small amount of sulfur dioxide or alkali from line 197, which reacts with any excess chlorine dioxide to reduce the amount of free chlorine dioxide leaving the bleaching tower 193. The diluted slurry is then carried by line 195 and pump 196 to vat 200 of washer 201. During its passage through line 195, the slurry is again diluted, e.g., to a consistency of about 1 to about 1.5 wt. %, when it reaches vat 200, and is again treated with additional sulfur dioxide from line 198. The pulp is picked up on vacuum drum 202, and any reaction products and unreacted bleaching chemicals are washed from it prior to being removed as pulp mat 203.

It should be understood that while the initial chlorine dioxide, stage is described above in relation to an extraction tower separate from washer 201, a diffuser can be employed wherein the reaction between the pulp and chlorine dioxide occurs in the same vessel in which washing of the pulp occurs. Diffusers are available commercially from numerous sources such as Ahlstrom and Kvaerner and their operation is well understood.

The pulp is then moved to steam mixer 206 of the extraction stage, usually by gravity drop through a chute. Sodium hydroxide from line 207 is added on washer 201 or at mixer 206. In mixer 206, the treated pulp mat 203 is mixed with steam from line 208. This slurry is then carried through line 209 by pump 210 to extraction tower 213. The conditions in this extraction stage serve to remove lignin and unwanted chemicals. This tower may be a downflow or an upflow tower.

After the appropriate dwell time, the pulp enters dilution zone 214, and its consistency is reduced, e.g., to approximately 5 wt. %. The pulp is then carried through line 215 by pump 216 to vat 220 of washer 221. Washer 221 is also shown and described as a vacuum or pressure dome washer but it may be a diffusion washer. Again, the bleached pulp is diluted, e.g., to a consistency of about 1 to 1.5 wt. % before entering the vat. The slurry is picked up by vacuum drum 222 and washed and discharged as pulp mat 223. If necessary, the pH of the pulp may be adjusted by treating the mat with sodium hydroxide from line 227. This may occur on the drum 222 or in the steam mixer 226.

The pulp then enters the last chlorine dioxide stage. The conditions and flow in this stage are the same as in the first chlorine dioxide stage. The pulp is dropped into or carried to steam mixer 226, and mixed with steam from line 228. The slurry is carried through line 229 by pump 230 to mixer 231, mixed with chlorine dioxide from line 232 and carried into the chlorine dioxide tower 233, shown as an upflow/downflow tower, where it remains from about 1 to 4 hours. The pulp then enters dilution zone 234 where its consistency is reduced, e.g., to about 5 wt. %. It is also treated with a small amount of sulfur dioxide from line 237 to remove any excess chlorine dioxide.

The slurry is then carried from dilution zone 234 through line 235 by pump 236. During its travel through line 235, the pulp is again treated with additional sulfur dioxide or alkali from line 238 to remove any free chlorine dioxide and is go further diluted, e.g., to a consistency of about 1 to about 1.5 wt. %, when it reaches vat 240 of washer 241. It is picked up by vacuum drum 242, washed and discharged from the bleaching system as bleached pulp 243.

The passage of liquid through washers 201, 221 and 241 is the same as in the brown stock washers. Wash water is sprayed onto the mat by the washer heads. This water displaces the entrained liquid within the pulp mat on the drum. The displaced liquid is carried through piping internally of the rotating vacuum drum to a pipe in the central shaft of the drum. Here it is combined with the liquor being pulled into the drum from the washer vat. This combined liquor passes outwardly through the central pipe in the drum and an external line to a seal or storage tank that maintains the vacuum in the drum by providing a seal between the vacuum inside the drum and the ambient pressure externally of the drum.

The filtrate after it leaves the seal or storage tanks can take one of two routes. First, the filtrate has been used to dilute the slurry within the washing stage or tower. For example, filtrate from seal tank 293 can be carried in line 297 by pump 298 into line 195 where the filtrate dilutes the slurry going to vat 200. Line 315 and pump 316 and line 317 and pump 318 carry filtrate from seal tank 313 of a second extraction stage washer 221 into line 215 to dilute the slurry going to vat 220; and line 335 and pump 336, and line 337 and pump 338, carry filtrate from seal tank 333 of the second chlorine dioxide washer 241 into line 235 to dilute the slurry going to vat 240. In the first chlorine dioxide stage, line 301 and pump 302 carry filtrate from seal tank 293 into the dilution zone 194. In the extraction stage, line 321 and pump 322 carry filtrate from seal tank 313 into dilution zone 214, and in the second chlorine dioxide stage, line 341 and pump 342 carry the effluent from the seal tank 333 into dilution zone 234.

Second, the filtrate not reused for dilution is discharged as effluent or to further processing as by line 294 from tank 293, line 314 from tank 313, and line 334 from tank 333.

The chemical, water and steam supplies to the system illustrated in FIGS. 1A, 1B and 1C are conventional. Process water is carried through line 360 to the various lines supplying water to the process, line 351 to digester lines 11 and 15, lines 37, 57, 77 and 97 to the brown stock washers 28, and lines 290, 310 and 330 to the bleach system washers. Alkali line 362 supplies dilute alkali to lines 187, 207 and 227. Chlorine dioxide line 363 provides a chlorine dioxide solution to lines 192 and 232. Steam is supplied through line 364 to steam lines 12, 209, and 229. Sulfur dioxide is supplied to lines 198, 237 and 238 from line 365.

SUMMARY OF THE INVENTION

The present invention relates to applicant's solution of the problem relating to the formation of barium scale in pulp bleaching processes, particular those that employ chlorine dioxide as a bleaching chemical. A bleaching process to which the present invention pertains includes a primary process stream comprising wood pulp that is washed prior to contacting the wood pulp with chlorine dioxide. In accordance with the present invention, the washed wood pulp after being contacted with the chlorine dioxide is washed in a post-chlorination washing stage to remove reaction products and unreacted chlorine dioxide. The method of the present invention includes the step of collecting filtrate from the post-chlorination washing stage and combining a portion of the collected filtrate with the primary process stream, preferably in or subsequent to a pre-bleach wash stage and prior to the introduction of the chlorine dioxide, in order to decrease the pH of the primary process stream. By introducing the collected filtrate from the post-chlorination washing stage into the primary process stream in accordance with the present invention, the need for acidifying chemicals, such as sulfuric acid, is reduced and preferably eliminated.

The benefits of reducing barium scale formation: in accordance with the present invention include: (1) reducing process down time and the costs associated with cleaning equipment to remove barium scale; (2) reducing the amount of barium scale that forms on the equipment so that the adverse impacts of such barium scale on the efficiency of the washing equipment is reduced, and (3) reduced chemical requirements. The present invention should find widespread application in many pulp bleaching processes that employ chlorine dioxide as a primary bleaching chemical.

BRIEF DESCRIPTION OF THE DRAWINGS

The foregoing aspects and many of the attendant advantages of the present invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1A:
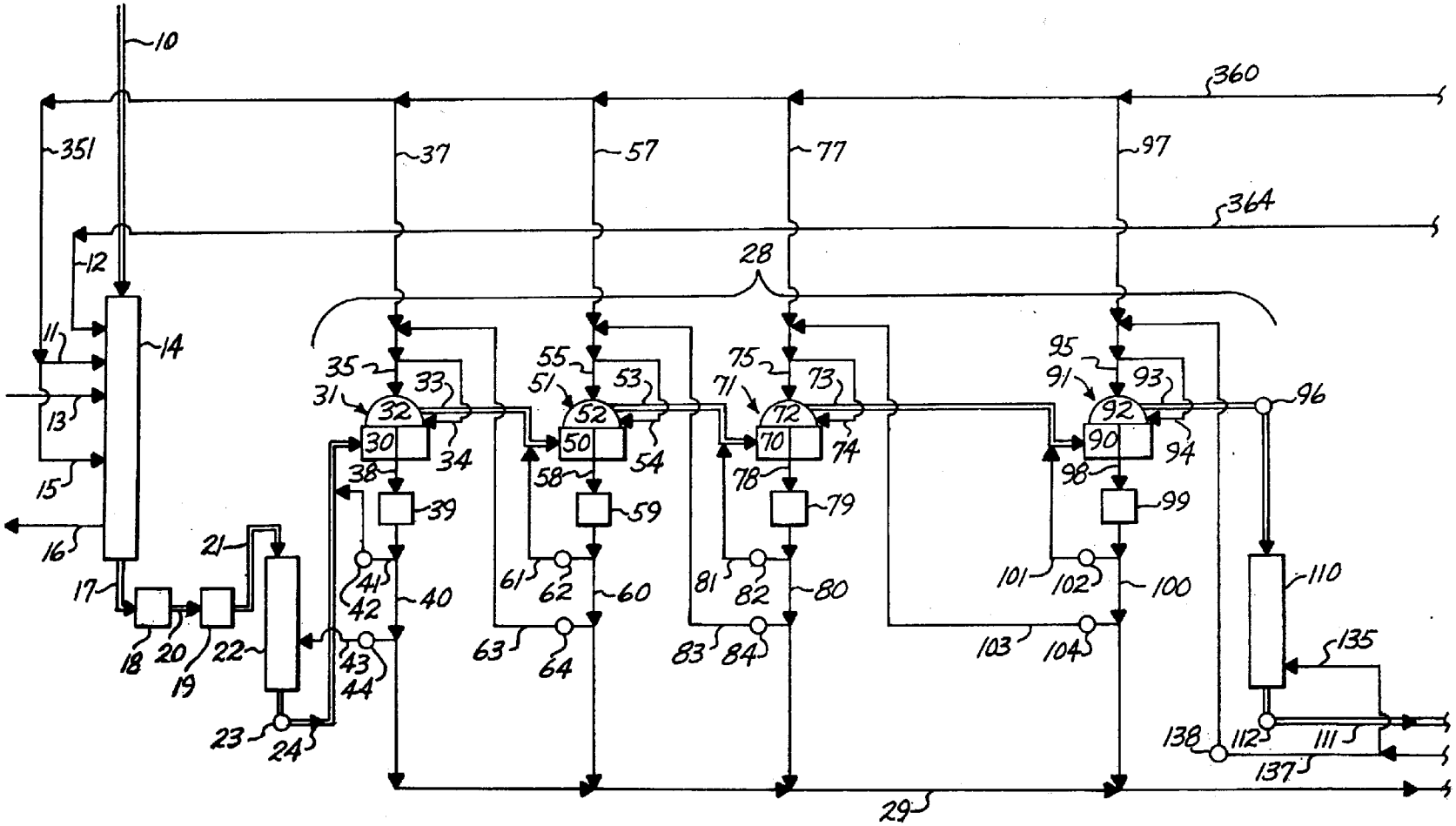
Fig. 1A. PRIOR ART
FIGS. 1A, 1B and 1C provide a schematic flow diagram for a typical wood pulp bleaching process that employs chlorine dioxide as a primary bleaching chemical and a DED system.
Figure 1B:
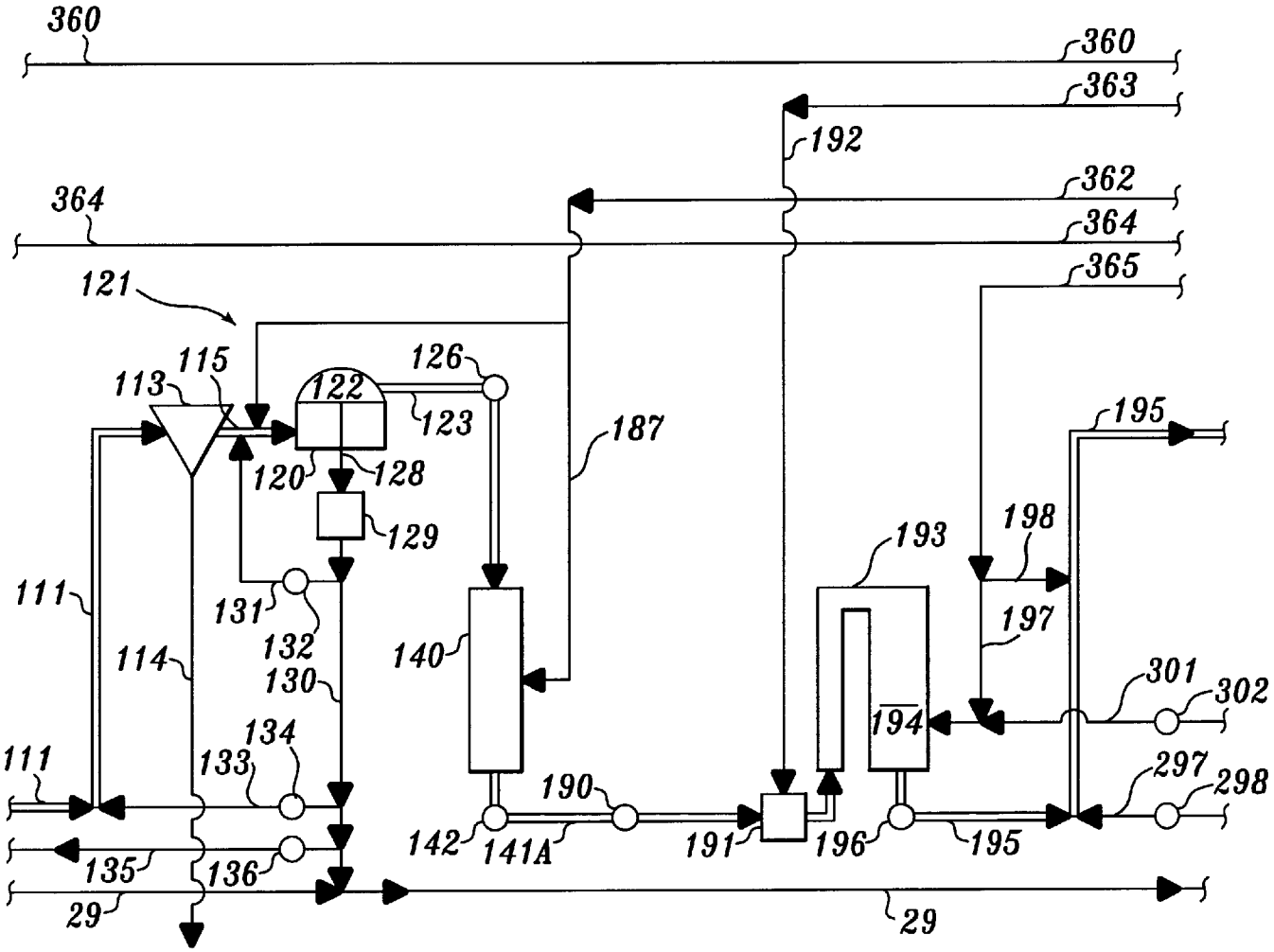
Fig. 1B. PRIOR ART
Figure 1C:
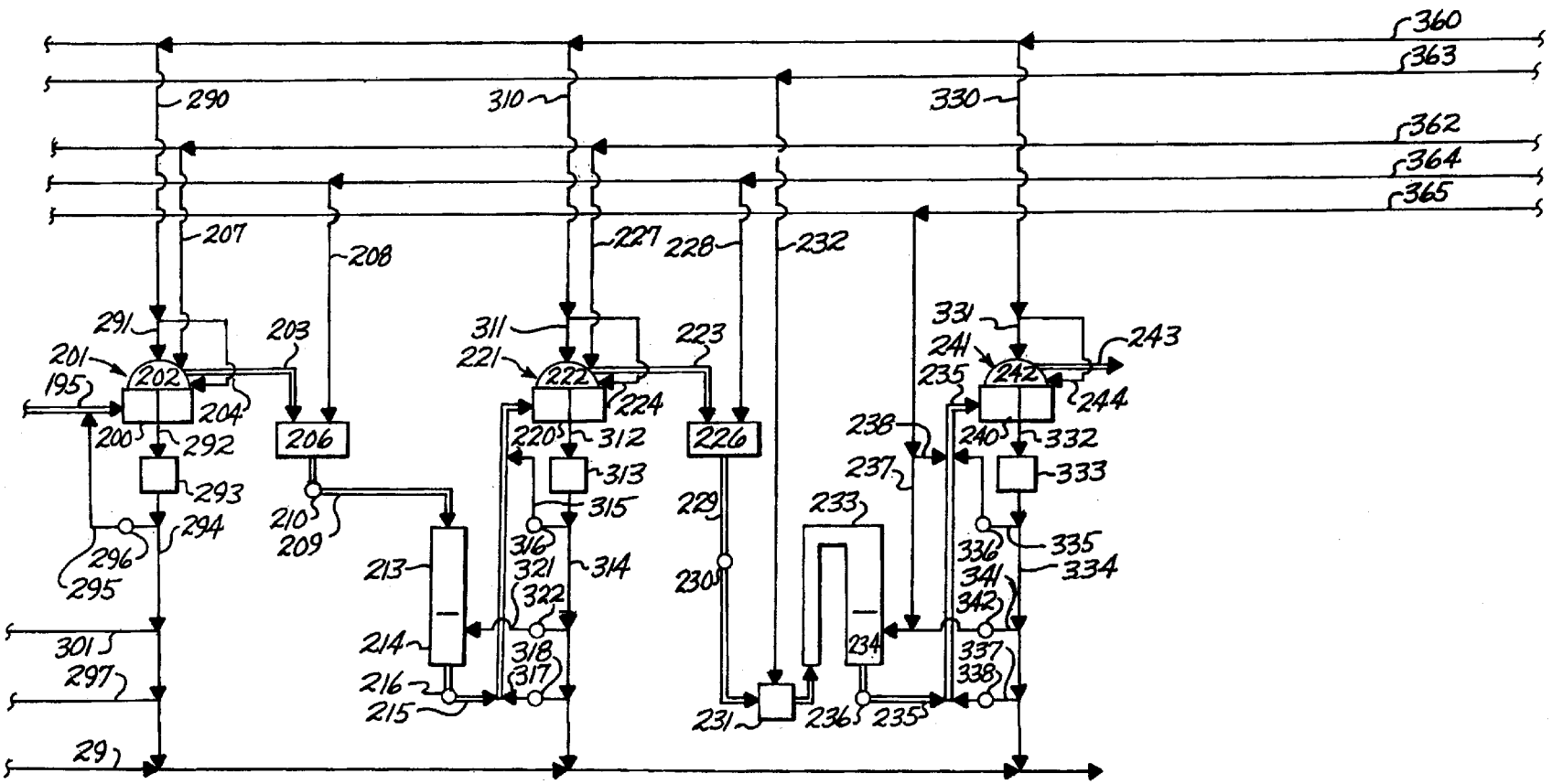
Fig. 1C. PRIOR ART
Figure 2D:
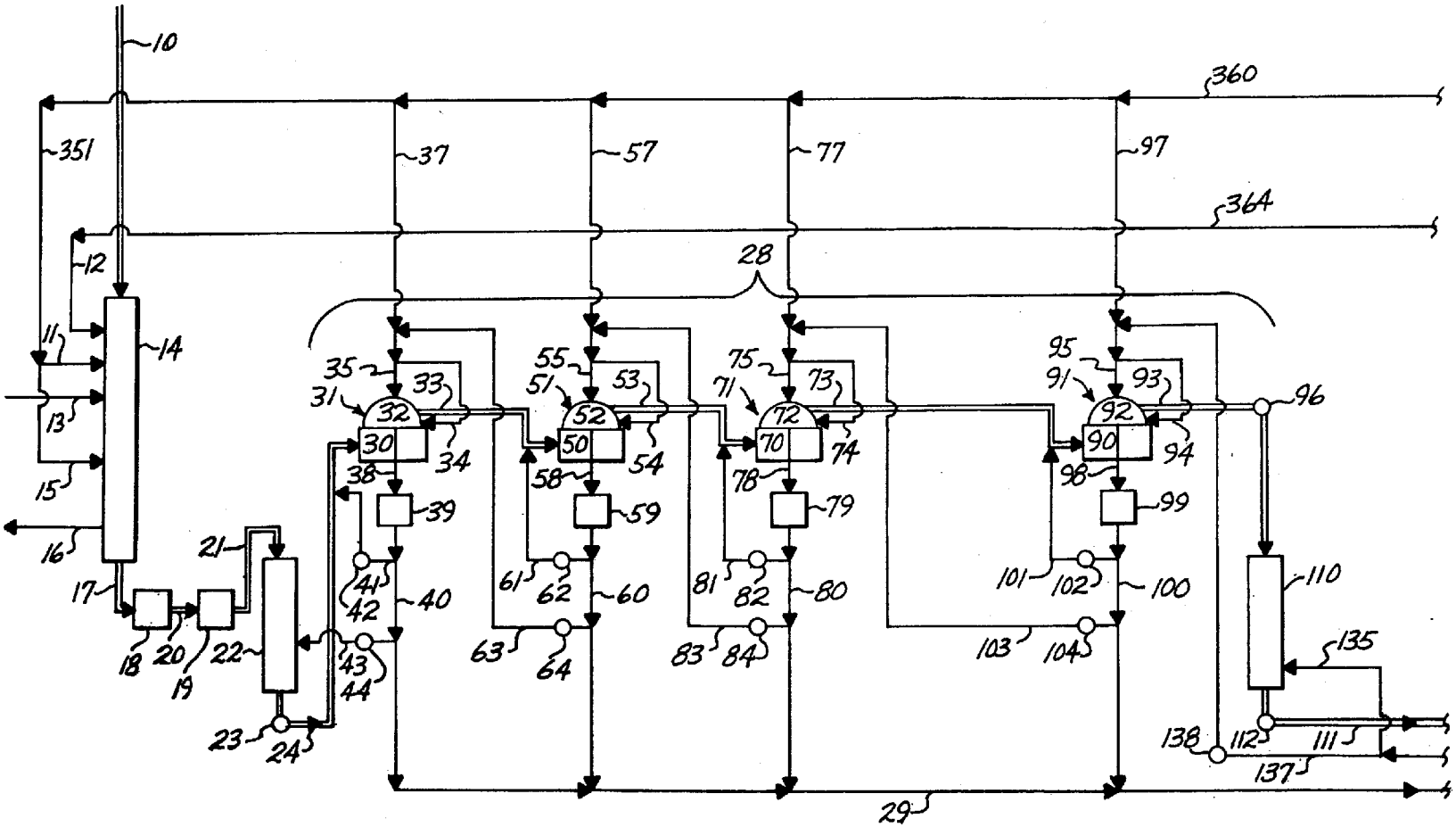
FIGS. 2A, 2B and 2C illustrate a schematic flow diagram for a wood pulp bleaching process using chlorine dioxide as a primary bleaching chemical and incorporating the method of the present invention for reducing the formation of barium scale.
Figure 2B:
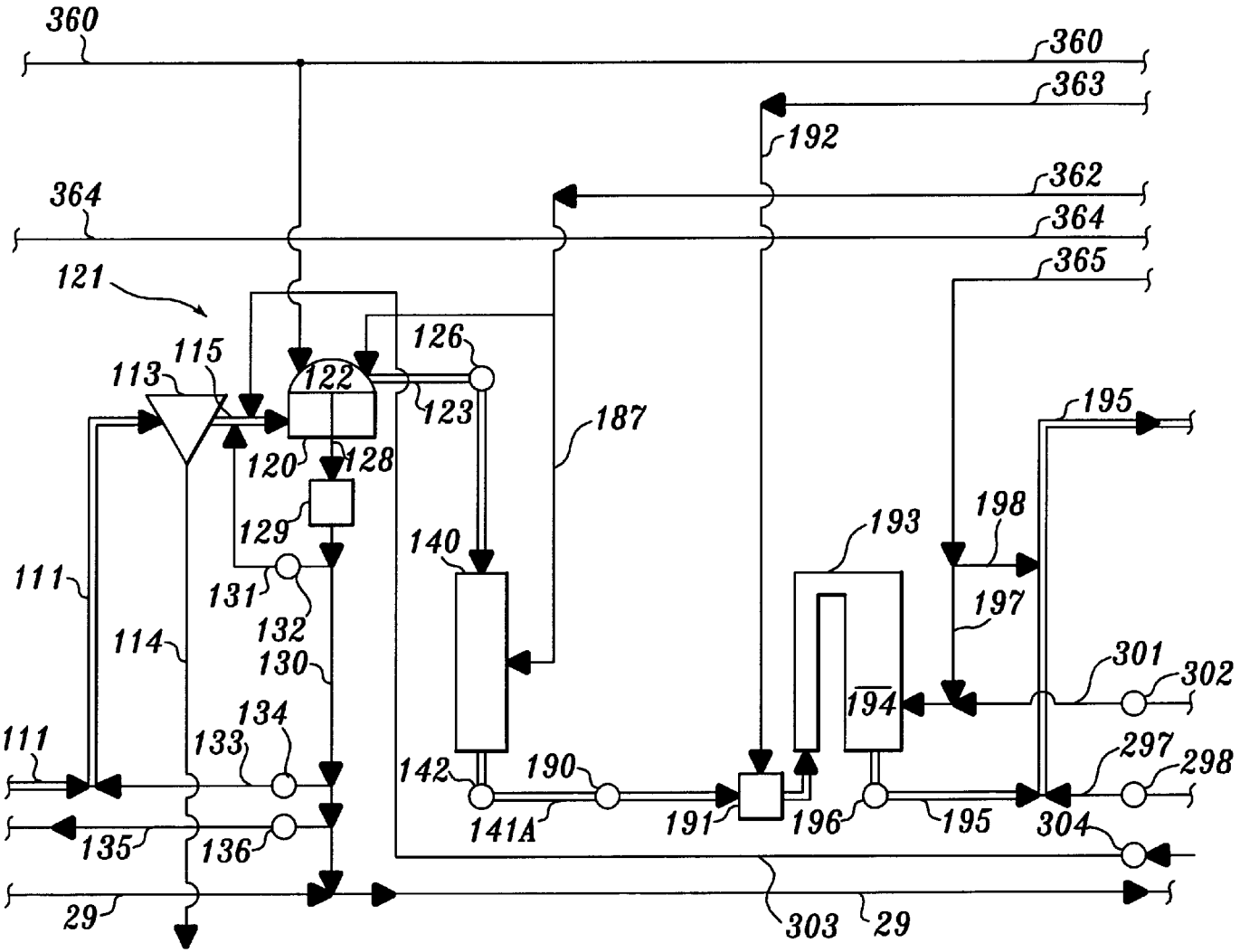
Figure 2B:
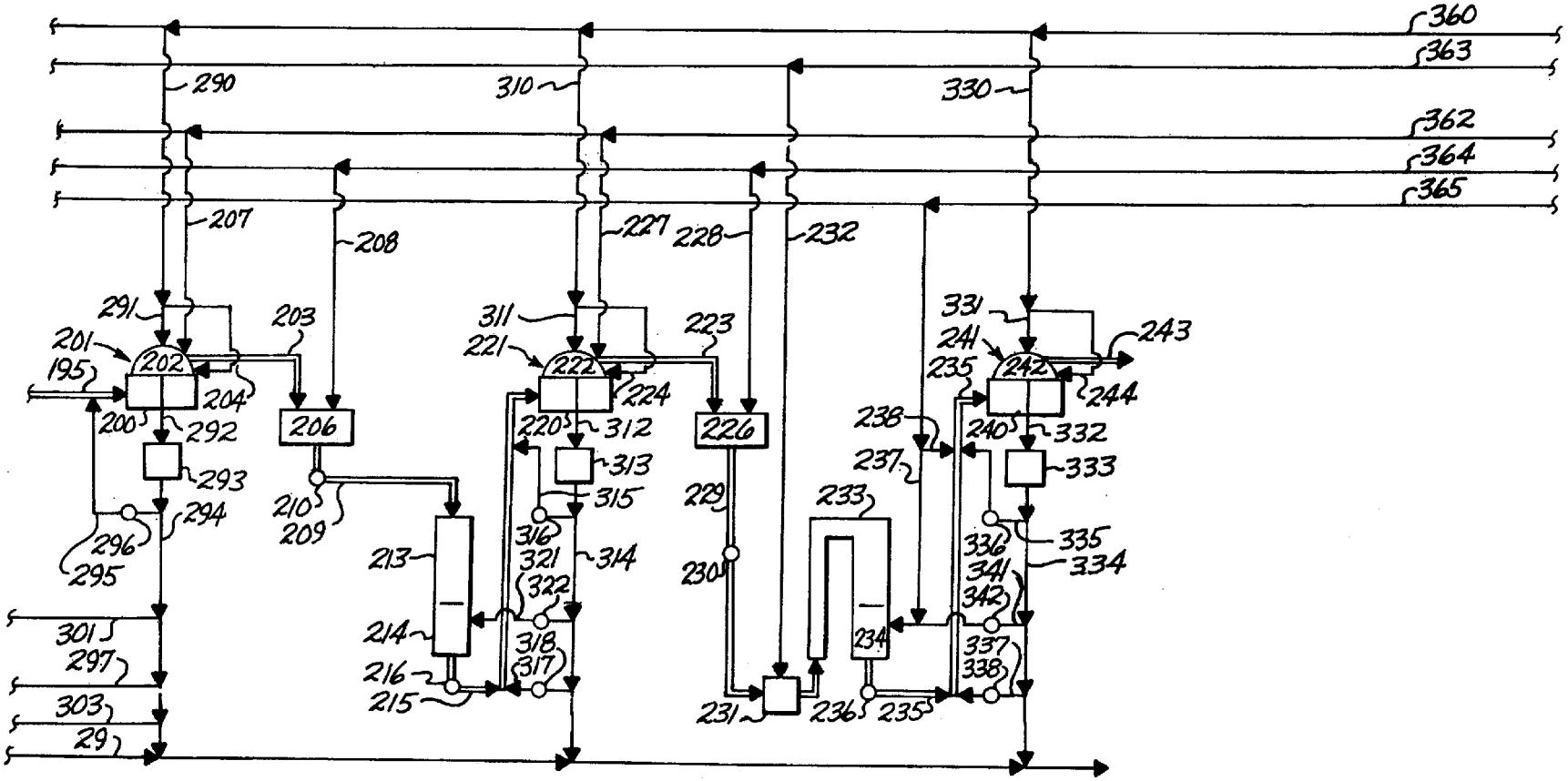

Referring to FIGS. 2A, 2B and 2C, one example of a wood pulp bleaching process that employs chlorine dioxide as a primary bleaching chemical to which the method of the present invention can be applied is substantially identical to the bleaching process described above in the background of the invention with reference to FIGS. 1A, 1B and 1C. It should be understood that the description of the present invention in the context of the specific configuration for a bleaching process is for illustrative purposes only and is not intended-to limit the scope of the present invention. The method of reducing barium scaling in accordance with the present invention is equally applicable to other pulp bleaching processes that employ chlorine dioxide as a bleaching chemical and suffer from the drawback of the formation of barium scale on equipment.

The present invention is best described with reference to FIGS. 2B and 2C. For the purposes of clarity, the same numbering convention has been adopted for FIGS. 2A, 2B and 2C for those features that are common between FIGS. 2A–2C and FIGS. 1A–1C.

As noted above in the background of the invention, brown stock solution in line 115 is delivered to decker 121 for removal of water and additionally washing to remove lignin and spent digestion chemicals. As an alternative to decker 121, a pre-bleach washer or press, such as a twin roll press can be utilized. It should be understood that the present invention is not limited to the particular type of equipment used to remove water and provide additional washing of the brown stock solution prior to its contacting with chlorine dioxide. For purposes of clarity, the method of the present invention will be described below in the context of the use of a decker as a type of equipment used as a pre-bleach washer.

The washed pulp leaving decker 121 is delivered to storage tank 140. From tank 140, the washed pulp is delivered to chlorine dioxide tower 193, where bleaching occurs under conventional conditions. After the bleaching process is considered complete, the pulp is delivered to post-bleach washer 201 where reaction products and unreacted chlorine dioxide are removed. As an alternative to the reaction tower 193 and washer 201 described above in the background of the invention, it is preferred in the context of the present invention that a diffusion tower be employed; however, other wash devices would be suitable, such as a drum or press. Such a diffuser tower combines the unit operations of the bleaching step and washing step into a single piece of equipment. In the following discussion, descriptions relating to washer 201 are equally applicable to the washing portion of a diffusion tower.

From washer 201, as described above in the background of the invention, the washed pulp proceeds on to the extraction phase and then a subsequent bleaching stage for processing under known conditions.

Figure 3:
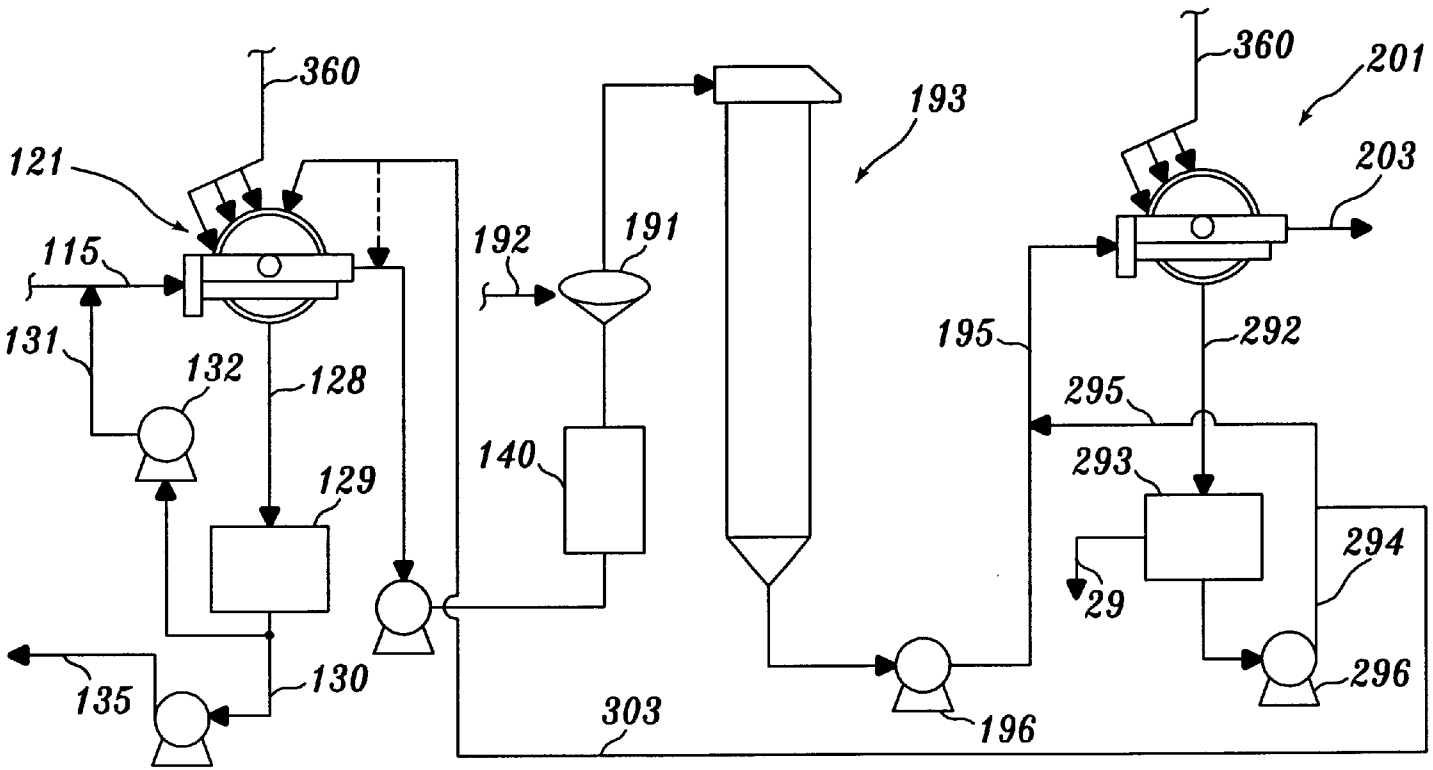
FIG. 3 illustrates a schematic flow diagram of a specific portion of the system of FIGS. 2A–2C that embodies the present invention.

FIG. 3 represents a portion of the pulp bleaching process illustrated in FIGS. 2B and 2C, but is simplified in order to exemplify the method of the present invention. FIG. 3 carries the same numbering convention as FIGS. 2B and 2C. Referring to FIGS. 2B, 2C and 3, in accordance with the present invention, filtrate from washer 201 is collected in line 292 and delivered via line 294 and 303 to decker 121, where it is combined with brown stock solution preferably prior to or simultaneously with the washing that occurs in decker 121. Filtrate from washer 201 is preferably introduced to the brown stock solution prior to or simultaneously with the washing that occurs in decker 121, so that the filtrate is available to be carried through the bleaching process with the pulp. In accordance with the present invention, the pH of the filtrate is lower than the pH of the primary pulp stream to which the filtrate is added. By applying the filtrate to the pulp prior to the first bleaching stage, the pH of the primary pulp stream can be reduced, preferably without the need for an acidifying agent, such as sulfuric acid. Introduction of the filtrate to the wood pulp at this location is also preferred because applicants have observed that a major amount of barium scale forms on the initial wash stage after the initial chlorine dioxide bleaching stage. Therefore, in order to reduce the amount of barium scale that occurs at this juncture, it is necessary to eliminate the presence of the sulfate ions prior to the initial wash stage.

The pH of the pulp stream 115 can range from about 7 to about 11 depending on the effectiveness of the brown stock washing. Accordingly, in order for filtrate in line 303 to be able to reduce the pH of stream 115, the pH of the filtrate should be lower than the pH of pulp stream 115, i.e., <7. Preferably, the pH of the filtrate in line 303 is about 2.0 to 5.0 and most preferably from about 2.5 to 3.0 in order to maximize the bleaching effect in tower 193. In addition to the magnitude of the difference between the pH of the process stream 115 and the pH of the filtrate in line 303, the amount of filtrate that is introduced into process stream 115 will effect the degree of reduction in the pH thereof While the present invention is not limited to any particular amount of filtrate in line 303 that is added to wood pulp stream 115, as a practical matter, the amount that can be introduced will be limited by the volumemetric capacity of washer 121 or other downstream processing equipment.

Ultimately, the amount of filtrate from line 303 introduced into line 115 is selected so that the pH of the wood pulp after addition of the filtrate is adjusted to fall within the range of about 3 to about 5, preferably about 4 to about 5. These particular pH ranges are preferred in part because of the conditions needed to provide the desired amount of bleaching in bleach tower 193. Other criteria to be considered in determining the pH of the wood pulp entering bleach tower 193 are well understood.

The filtrate can be applied to the wood pulp in a number of different manners, including applying it as a wash stream in decker 121. When the filtrate is applied to the pulp as a wash stream in decker 121, it is preferred that the filtrate be applied as high up on the drum of the washer as possible in order to minimize any break-through in the pulp sheet to the washer wire.

Referring to FIG. 3, it should be understood that in certain wood pulp bleaching processes, decker 121 may be replaced by a press as a means to dewater the brown stock solution. In those types of processes, the filtrate in line 303 can be applied after the press and prior to the first bleaching stage.

While the present invention has been described above in the context of a preferred embodiment, it should be understood that the method of reducing barium scale in accordance with the present invention is applicable to numerous configurations of chlorine dioxide bleaching of wood pulp. For example, the particular unit operation into which the recycled filtrate is introduced will vary from process to process. It will be appreciated that various changes can be made from the preferred embodiment illustrated and described above without departing from the spirit and scope of the present invention.

The embodiments of the invention in which an exclusive property or privilege is claimed are defined as follows:

1. A method of reducing the formation of barium scale in a wood pulp bleaching process using only chlorine dioxide as the bleaching chemical, the bleaching process including a brownstock stream comprising wood pulp that is contacted with the chlorine dioxide in an initial chlorine dioxide bleach stage to produce a chlorine dioxide bleached pulp and then washing said chlorine dioxide bleached pulp, in an initial chlorine dioxide washing stage, the method comprising:

collecting filtrate from the initial chlorine dioxide washing stage, the collected filtrate having a pH ranging from between about 2.5–3.0;

reducing the pH of the brownstock stream prior to contacting the brownstock stream with chlorine dioxide by combining a portion of the collected filtrate with the brownstock stream to produce a brownstock stream having a pH of 3.0–5.0; and bleaching said brownstock stream with chlorine dioxide in said initial chlorine dioxide bleach stage.

2. The method of claim 1, wherein the pH of the brownstock stream is reduced without the addition of a substantial amount of sulfuric acid.

* * * * *